US005522303A

United States Patent [19]

Stoll et al.

[11] Patent Number: 5,522,303

[45] Date of Patent: Jun. 4, 1996

[54] MACHINE TOOL WITH LOCKING MECHANISM

[75] Inventors: Kurt Stoll, Lenzhalde; Udo Preussler, Leinfelden-Echterdingen; Peter Grund, Trossingen, all of Germany

[73] Assignees: Festo KG of Ruiter, Esslingen; Chiron-Werke GmbH & Co. KG, Tuttlingen, both of Germany

[21] Appl. No.: 331,490

[22] PCT Filed: Mar. 2, 1994

[86] PCT No.: PCT/EP94/00600

§ 371 Date: Jan. 3, 1995

§ 102(e) Date: Jan. 3, 1995

[87] PCT Pub. No.: WO94/20261

PCT Pub. Date: Sep. 15, 1994

[30] Foreign Application Priority Data

Mar. 3, 1993 [DE] Germany ..... 9303050 U

[51] Int. Cl.[6] ..... F15B 15/26

[52] U.S. Cl. ..... 92/27; 60/406

[58] Field of Search ..... 60/406; 91/466; 92/5 R 27

[56] References Cited

U.S. PATENT DOCUMENTS

| | | | |
|---|---|---|---|
| 2,130,618 | 9/1938 | Gnavi . | |
| 2,139,185 | 12/1938 | Engel . | |
| 2,532,768 | 12/1950 | Halward . | |
| 2,845,902 | 8/1958 | Anderson . | |
| 3,033,171 | 5/1962 | Engelbrecht et al. | 92/27 |
| 3,889,576 | 6/1975 | Sheffer et al. | 92/27 |
| 4,043,252 | 8/1977 | Wawrzyniak . | |
| 4,116,113 | 9/1978 | Leclerc | 92/27 |
| 4,524,676 | 6/1985 | Rogers . | |
| 4,987,822 | 1/1991 | Stoll | 91/358 R |

FOREIGN PATENT DOCUMENTS

| | | |
|---|---|---|
| 0205030 | 12/1986 | European Pat. Off. . |
| 729168 | 12/1942 | Germany . |
| 3942348 | 6/1991 | Germany . |
| 4010040 | 10/1991 | Germany . |

*Primary Examiner*—F. Daniel Lopez
*Attorney, Agent, or Firm*—Hoffmann & Baron

[57] ABSTRACT

A machine tool is suggested, which has a headstock (111) and at least one tool changer (120). The tool changer (120) moves production tools (116) between a magazine position and a working position, at least one fluid power drive cylinder (1) being associated with it as a drive unit (123). On the drive cylinder (1) a locking device (52) is provided, which when a working pressure of the drive piston (6) drops below a predetermined value produces a mechanical locking action of the drive cylinder piston in relation to the housing. To release the mechanical locking, a setting force due to the working pressure must be overcome.

21 Claims, 2 Drawing Sheets

MACHINE TOOL WITH LOCKING MECHANISM

The invention relates to a machine tool comprising a headstock, at least one tool changer adapted to move production tools between a magazine position and a working position, and at least one fluid power drive cylinder associated with the tool changer as a drive unit, said cylinder having a cylinder housing, in which an axially moving piston is arranged.

A machine tool of this type is for instance disclosed in the European patent publication 0 205 030 A2. The drive cylinder is in this case dependent, the piston rod connected with the piston being directed vertically downward therefrom and bearing the object to be manipulated, generally a production tool. When the machine tool is not in the operative condition the drive cylinder is in a withdrawn position, the drive piston assuming an end of stroke position near the upper terminating wall of the cylinder housing. During long periods in which the drive cylinder is not used, this length of the stroke is not constant. Owing to a reduction in the operating pressure the piston tends to move down, under the constant weight acting on it, toward the extended position of the drive cylinder. Apart from dangers with may arise, this may also lead to impairment of function of the machine tools equipped with the drive cylinder. Therefore so far attempts have been made to evolve external and intricate support structure in order to lock the drive cylinder during idle times.

In known machine tools there is furthermore the disadvantage that the power valves and any pilot valves must be arranged on the machine tools themselves so that during the final assembly of such machine tools arranging piping and wiring is complex, for the pneumatic and also for the electrical systems.

Taking this as a starting point one object of the present invention is to so improve on a machine tool of the type initially mentioned that, while maintaining a generally compact design the drive piston can be reliably locked during idle times with the result that when the machine tool is put into use again no dangerous situations occur. Furthermore low-wear operation is to be possible.

In accordance with the invention this object is to be attained by the provision of a locking mechanism on the drive cylinder, which is adapted to mechanically lock in relation to the housing if a release pressure of the piston should drop.

In case of need, that is to say, if the release pressure should fail, the locking mechanism ensures mechanical locking of the drive piston in relation to the housing so that the piston is prevented from moving out of the end of stroke position it previously reached.

Further advantageous forms of the invention are recited in the dependent claims.

If the locking device is integrated in the drive cylinder and, as is preferred, the release pressure is the operating pressure of the drive cylinder, final assembly of the novel machine tool becomes very simple. In fact it is merely necessary to arrange one fluid power line running to the drive unit, via which both the operating pressure and also the release pressure for the locking device is supplied. If the operating pressure should drop, and accordingly the release pressure, in the novel machine tool the tool changers located in the end of stroke setting will be mechanically locked so that they are not able to move downward. This involves the advantage that when the novel machine tool is turned off or there is a failure of the compressed air supply the tool changers are not able to "sag", something which would lead to a dangerous or a confused operational situation.

The locking action is preferably only effective if the drive cylinder is outside the ready for operation condition so that it is merely during short machine related idle times that no locking is necessary. This may be ensured by always having a sufficient level of release pressure, which maintains the second transversely moving locking part in a release setting. It is only when the release pressure sinks to below a certain and more particularly predetermined value that, acted upon by the locking force, the second locking part goes into the locking setting, in which it cooperates with the piston-locked first locking part. The drive piston is then essentially locked to prevent axial motion and renewal of operation is only possible when the release pressure has regained the necessary level. A factor reducing wear is here that the locking mechanism is independent of the pressure in the working spaces of the drive cylinder so that during proper operation of the drive cylinder there is as a rule no engagement of the locking parts. It is convenient to select the working pressure of the drive cylinder as being the release pressure and to switch the central drive fluid supply directly as the release pressure to the second locking part.

If the drive cylinder is designed as the drive unit for a tool changer of a machine tool, then it will be normally so connected that the drive piston is driven toward the retracted position so that it is firstly forced to move into the already described end of stroke position. It may however now happen that as part of servicing operations while the equipment is idle, the associated control valve will be switched reversed without this being noticed. This may mean that the piston is immediately driven in the extension direction as soon as the drive cylinder is put into operation. An abrupt outward movement of the piston rod could then result with damage to the machine or injury to persons. In order to ensure operational reliability in such cases the locking means provided on the two locking parts are preferably so designed that it is not possible for the release pressure to shift the second locking part out from the locked setting and into the release position as long as the first locking part assuming the locking position is subjected to a certain setting force acting to produce axial movement of the drive piston out of the end of stroke position. The said "certain setting force" is produced for instance in the above mentioned case since the drive piston, when the system becomes operational, is immediately connected with the operating pressure in the extension direction. When this is the case the locking means, which are in engagement with one another, mechanically prevent the second locking part from leaving the locking position toward the release position, even if the locking part is acted upon by the release pressure. It is only when the action on the working spaces is corrected again and the drive piston is moved in the retracting direction that the locking means necessary release the drive piston. In the case of the German patent publication 3,942,348 A1 unlocking takes place automatically with a time delay owing to the drive fluid supplied for driving the drive piston.

The terminal wall fitted with the locking device is preferably an end plate of the drive cylinder, which in the case of a drive piston fitted with a piston rod is preferably located on the axial side of the drive piston. On this cylinder end plate a power valve in the form of a multiway valve is preferably also mounted, which is responsible for the supply of drive fluid to the working spaces of the drive cylinder. It is preferably operated by at least one electrically operated pilot valve, for instance a solenoid valve, which can be also mounted on the housing end plate. The entire electrical system is preferably located in a central equipment space, which may be covered by a removable protective hood. The distribution of compressed air between the pilot valve, the power valve and the working spaces is preferably performed by channels formed in the interior of the cylinder housing so that all in all a highly integrated subassembly is provided for the line for the operating pressure.

The drive cylinder is preferably pneumatically operated. Accordingly only two connection lines are required, one pressure line for air supply and a more particularly multicore electrical cable for the operation of the pilot valves and any sensors which may be present and employed for detection of the position of the piston.

The invention will be now described with reference to the drawings in more detail.

Figure 1:
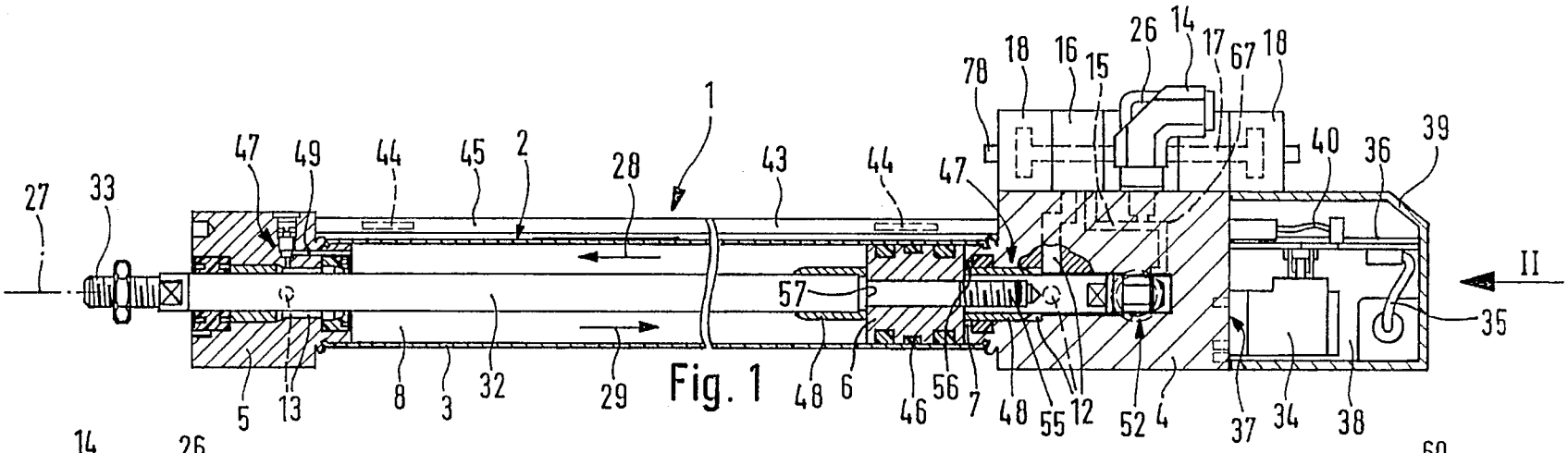
FIG. 1 shows a preferred embodiment of the drive cylinder in a longitudinal section.

FIG. 1 shows a pneumatically operated drive cylinder 1 whose cylinder housing 2 comprises a central tubular housing section 3, which at either end is terminated by a respective end wall in the form of a housing end plate 4 and 5. In the tubular housing section 3 there is an axially moving drive piston 6, which seals off two working spaces 7 and 8 from one another. Into each working space 7 and 8 there opens a pressure fluid duct 12 and 13 of the associated housing end plate 4 and 5.

On the housing end plate 4 arranged on the right in terms of FIG. 1 a connection device 14 is provided, via which a pressure line, as for example in the form of a hose, may be connected. The connection device 14 is in communication with a supply duct 15 extending in the housing end plate 4 and which leads to a power valve 16, which is also detachably connected with an exterior surface of the housing end plate 4. Since such power valves are as such known in the art and familiar to the man in the art, a detailed description thereof is unnecessary here. It may for instance be a question of a 5/2 way valve, which comprises a spool 17, which by suitable operating means 18 of the power valve 16 may be moved into the required position. Dependent on the position of switching it is possible for pressure fluid arriving via the supply duct 15 to be caused to flow into the one or other of the pressure ducts 12 and 13. The pressure duct 12 connected with the associated working space 7 preferably extends completely in the interior of the housing end plate 4 bearing the power valve 16. The connection with the pressure duct 13 of the other housing end plate 5 is preferably by way of a fluid channel 23 in a rod 22 which extends parallel to the tubular housing section 3 adjacent to the latter between the two housing end plates 4 and 5. This fluid duct 23 communicates on the one hand with the pressure line 13 and on the other hand with a duct section 24, which in the housing end plate 4 produces the connection with the power valve 16.

Figure 2:
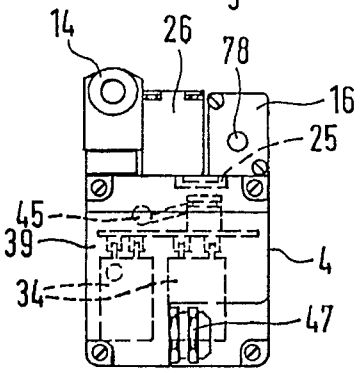
FIG. 2 shows a rear elevation of the drive cylinder in accordance with FIG. 1 looking axially in the direction of the arrow II.

The power valve 16 furthermore communicates with at least one venting duct 25 (FIG. 2) also extending in the interior of housing end plate 4 and which opens in a silencer 26, which is also attached to the housing end plate 5. Preferably the power valve 16, the silencer 26 and the connection device 14 are arranged on a common, flat mounting surface on the housing end plate 4, whose normal vector extends at a right angle to the longitudinal axis 27 of the drive cylinder 1.

The drive piston 6 is attached to a piston rod 32, which extends axially and extends through the housing end plate 5, which is to the right in terms of FIG. 1, centrally. On the external part of the piston rod 32 an attachment device 33 is provided, on which an object to be moved may be detachably secured. Dependent on the position of switching of the power valve 16 there will be an outer stroke in accordance with arrow 28 or a retraction stroke in accordance with arrow 29.

The switched position of the power valve 16 is affected by the operating devices 18, which communicate via channel, not illustrated in detail, in the interior of the housing end plate 4 with two electrically operated pilot valves 34 which are also mounted on the housing end plate 4 and are more particularly mounted on the end thereof 37 facing away from the tubular housing section 3. It is a question of solenoid valves. The supply of electrical power thereto is by means of wires 35, which are connected with a printed circuit board 36, which is arranged in electrical plugging contact with the pilot valves 34. The printed circuit board 36 is, like the pilot valves 34, preferably accommodated in an equipment space 38, which adjoins the end 37 of the housing end plate 4 and is under a removable protective cover 39. Furthermore further control lines 40 may be electrically connected with the printed circuit board 36, which belong to a sensor device 43, with which the position of the drive piston 6 can be detected in relation to the cylinder housing 2. The sensor device 43 may have a sensor rod 45 fitted with sensors 44, and which is fixed in a receiving hole (not illustrated) in the housing end plate 4, through which it extends outward in order to assume a position to the side of the tubular housing section 3. For contactless operation of the sensors 44 a permanent magnet arrangement 46 is provided on the drive piston 6 so as to move with the same.

All electrical connections are accordingly well screened by being accommodated in the equipment space 38. The control lines 35 are preferably joined with an electrical coupling 47 on the protective hood 39, with which connection lines (not illustrated) are able to be connected. In addition to the electrical connection all fluid power connection are provided adjacent to the one housing end plate 4 which is remote from the piston rod 32.

The drive cylinder is moreover provided with a damping device 47 for terminal fluid damping of the drive piston 6. It is based on the familiar principle in accordance with which the apertures of the fluid power ducts 12 and 13 are shut off as the drive piston 6 draws close to the respectively associated end of stroke by a more particularly piston- or sleeve-like buffer part 48, which plunges into the aperture of the duct. The fluid which was previously able to leave the open fluid power duct may now only escape through a parallel connected choke duct 49, which is only shown in the housing end plate 5 adjacent to the piston rodIn order to make the drawing more straightforward. Since through choke duct 49 it is merely possible for a reduced volumetric flow to escape, the drive piston 6 is smoothly braked so that it will only strike the respective housing end plate 4 or 5 in the respective end of stroke position with reduced intensity.

In addition to the details of design so far described, the drive cylinder 1 preferably possesses a locking device 52 for releasable mechanical locking of the drive piston 6 in relation to the housing in at least one end of stroke position. Its design is to be seen more especially in FIGS. 3 and 4, where by way of example it merely serves for stopping in one end of stroke position, that is to say the terminal position which is assumed by the drive piston in the retracted position, in which it abuts against the housing end plate 4 on the right in terms of FIG. 1.

The locking device 52 comprises firstly a first locking part 53 secured to the piston. It is located on the axial side, which is adjacent to the housing end plate 4 on the retraction side, of the drive piston 6 and is constituted for instance by the free terminal section of a rod- or bolt-like part 54, which is screwed of the free end 55, placed within the tubular housing section 3, of the piston rod 32. The bolt-like part 54 in this case simultaneously serves as an attachment means for the drive piston 6, which is seated on a portion of the free end 55 axially between the bolt-like part 54 and a step 57 on the piston rod 32. It is furthermore possible for the bolt-like part 54 to function a bearer for the associated buffer part 48, which is preferably held in an annular recess, which is located between the bolt-like part 54 and the adjacent axial end 56 in the drive piston 6.

A second locking part 58, fixed to the housing, is received in a transverse hole 59, extending at a right angle to the longitudinal axis 27, in the housing end plate 4. It is able to be reciprocated in the longitudinal direction of this transverse hole 59 as indicated by the double arrow 60 between the release position depicted in FIG. 3 and the locking position illustrated in FIG. 4. In the locking position it is in engagement with the first locking part 53, when the same assumes the arrested position of FIGS. 3 and 4, in which the drive piston 6 is in the associated end of stroke position. In the locking position the drive piston 6 and the piston rod 32 are mechanically prevented from moving outward, owing to the engagement of the two locking parts 53 and 58. In the release position on the other hand a corresponding axial movement of the said parts is readily possible.

The second locking part 58 is for instance integrally connected with a locking piston 63, which also runs longitudinally in the transverse hole 59. Since its diameter is larger than that of the second locking part 58, it is located in a wider hole section 64 on the outer side, remote from the locking part 58, of the second locking part 58. In the wider hole section 64 the locking piston divides two fluid action spaces 65 and 66 from one another. The inner fluid action space 65, which is adjacent to the first locking part 53, communicates via a pressure duct 67 with a connection device 14. The pressure duct 67 preferably extends in the interior of the housing end plate 4 and may open into the supply duct 15. If during operation the drive cylinder 1 receives fluid at a certain operating pressure via the connection device 14,then this operating pressure will automatically be present, owing to the pressure duct 67, in the inner fluid action space 65 at the full pressure level independently of the switched condition of the power valve 16. This operating pressure also constitutes a release pressure, which acts on the second locking part 58 via the locking piston 63 tending to move the same toward release position, keeping same constantly in the release position.

In order to prevent leakages, the internal fluid action space 65 is sealed off both as regards external fluid action space 66 and also as regards the receiving opening 68 in the housing end plate 4, which receives the first locking part 53 in the arrested position. The receiving opening 68 is for example a recess like an blind hole axial into which the bolt-shaped part 54 plunges, at least to a substantial extent in the respective end of stroke position and whose wall surface facing toward the working space 7 constitutes the aperture of the pressure duct 12.

In order to provide for the said sealing effects for instance a seal ring 69 is provided both on the second locking part 58 and on the locking piston 63, such ring sealing against the respective wall surface of the transverse hole 59 without interfering with the transverse movement as indicated by the arrow 60.

A mechanical compression spring arrangement 69 is provided in the external fluid action space 66. In the illustrated example it bears at one end against the floor of a central recess 70 in the locking piston 63 and/or in the second locking part 58, whereas at the other end it runs on a detachable closing cap 73, which shuts off the transverse hole 59 adjacent to the external side of the housing end plate 4.

Instead of a mechanical spring it would be feasible also to provide a gas or pneumatic spring. At any rate the respective spring arrangement provides for an elastically yielding locking force, which constantly urges the second locking part 58 toward the locking position in accordance with FIG. 4 with a biasing action.

Figure 3:
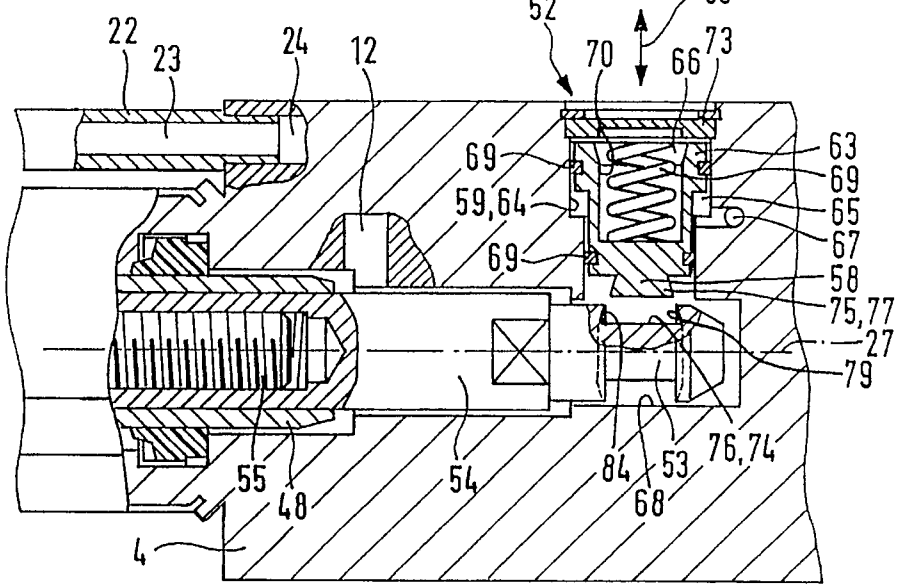
FIG. 3 shows a portion of the drive cylinder in accordance with FIG. 1 on a larger scale adjacent to the end plate having the locking device, again in longitudinal section but turned through 90° out of the position of FIG. 1.

When the drive cylinder 1 is in the condition ready for operation, the supply duct 15 will be at the operating pressure, such pressure acting via the pressure duct 67 in the internal fluid action space 65 as well and constantly keeping the second locking part 58 in the release position depicted in FIG. 3. The position of the second locking part 58 therefore is not dependent on the position of the drive piston 6 and/or on the working pressures values obtaining in the working spaces 7 and 8. The acting area of the locking piston 63 is consequently matched to suit the operating pressure so that the resulting forces directed toward the release position are in any case greater than the locking force of the fluid or mechanical spring arrangement 69. It is only when the operating pressure has gone below a certain value, as may be the case if for instance the drive cylinder is left idle overnight or at a weekend, the locking force will be able to override the release force and move the second locking part 58 into the locking position. Accordingly owing to the small frequency of response there is consequently an arrangement which is extremely low in wear while being able to meet maximum safety requirements. Instead of the operating pressure it is also possible to provide for an other release pressure as a reference pressure, and in this case one may be guided by the respective conditions of application.

Figure 4:
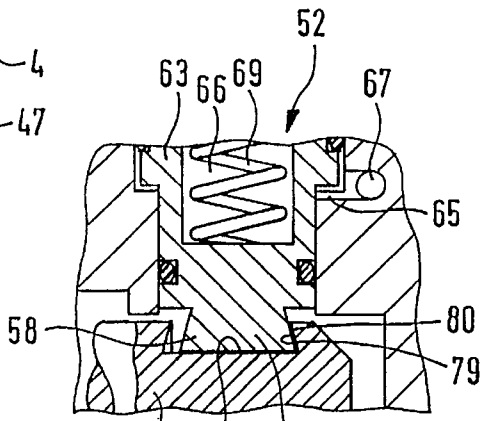
FIG. 4 shows a part on a larger scale of the locking device in accordance with FIG. 3, the second locking part, unlike the release position illustrated in FIG. 3, being in the locking position in engagement with the first locking part which is locked with the piston

At each locking part 53 and 58 at least one locking means 74 and 75 is provided, which fit together in the locking position as shown in FIG. 4. As locking means 74 of the locking part 53 it is preferred to provide a recess 76, which is more especially designed in the form of an annular groove, which extends coaxially to the piston rod 32. This offers the advantage that even without measures to prevent relative rotation for the first locking part 53 it is always possible to ensure that in the arrested position the recess 76 is aligned, as regards the direction 60 of movement, with the locking means 75 of the second locking part 58. The last named locking means 75 is a projection 77 preferably extending radially inward and in relation to the longitudinal axis 27, which projection 77 in the arresting position of the first part 53, may move into and out of the recess 76 without hinderance.

In the locking position the projection 77 extends into the recess 76 so that the locking means 74 and 75 fit around behind in the longitudinal direction 27. There is therefore an interlocking and extremely safe locking action in the longitudinal direction 27.

As soon as the pressure obtaining in the internal fluid action space has returned to the release pressure, which is in the working example is the operating pressure, the locking action is automatically overridden and the moving assembly comprising the piston rod 32, the piston 6 and the first locking part 53 is released so that it may perform a new stroke.

A further safety measure is constituted by the locking device 52 in the example. In accordance with such locking device the two locking means 74 and 75 have such a structure that for example the release pressure, which is constituted by the operating pressure for instance, is not in a position to shift the second locking part 58 out from the locking position into the release position as long as the first locking part 53, which is in the arresting position, is subjected to a certain setting force acting in the direction of an outward stroke. This is made possible in the example herein since the locking means 74 and 75 are so designed that they may interlock in a positive fashion in the setting direction 60 of the locking part 58.

It is more especially when the drive cylinder 1 is employed with the piston rod extending downward and it is In the home position with the piston rod retracted, that such an operation of the drive piston 6 will be preferred such that each time the equipment 1s operated again firstly the working space 8 on the piston rod side is supplied with operating pressure. This will prevent the piston rod being suddenly jerked outward as it is put into operation, something which might otherwise involve serious injury and/or damage. The respective control is effected using the position of switching of the power valve 16.

A case may now occur such that during an idle period, more particularly for servicing, temporary operation will be performed with control of the drive cylinder 1, for example by manual operation of the power valve 16, which for this purpose has an auxiliary manual control 78. As a consequence of this there is the possibility of the power valve's being left in an undesired setting after the end of servicing work, in which, when operation is resumed, pressure fluid is supplied not to the working space 8 on the piston rod side but to the opposite working space 8. Without the above mentioned design measures the operating pressure would then override the locking device and extends the piston rod 32 with a jerk.

On the basis of the above described design of the locking means 74 and 75 the second locking part 58 is not able to come out from the locking position as long as the first locking part 53, which is in the arresting position, is urged in the extension direction as indicated by the arrow 28. The interlocking anchoring of the second locking part in relation to the second locking part opposes the release pressure mechanically. It is only after the control effect has been corrected and the drive cylinder 6 is acted upon in the retracting direction as indicated by the arrow 29 that the first locking part 53 renders possible the release of the second locking part 58 and shifting thereof into the release position.

In the specific case of the embodiment of the invention the respective, desired design of the locking means 74 and 75 is produced because the recess 76 is delimited on the axial side remote from the drive piston 6 by a locking surface 79, which possesses at least one area portion, which is further removed from the drive piston 6 than an area portion which does not lie so deep in the direction 60 of movement. This condition is fulfilled if the first locking surface 79, as seen in longitudinal section taken through the first locking part 53, is an oblique surface. In the case of a circumferential annular recess the first recess surface 79 will preferably have the configuration of the internal surface of a hollow frustum of a cone. On the projection 77 there is a second locking surface 80, which as seen in longitudinal section is complementary to the first locking surface 79 so that the two locking surfaces 79 and 80 are able to engage each other along a respective portion of the periphery in the locking position as shown in FIG. 4.

There is preferably a provision such that the first locking part 53 in the arresting position has, when the second locking part 58 is in the locking position, a certain amount of axial play in the direction of the longitudinal axis 27. When the drive piston 6 assumes its end of stroke position, it is possible for the projection 77 having the oblique second locking surface 80, to be moved into and out of the locking position without any difficulty. In the locking position the two locking surfaces 79 and 80 are not urged together by any force or at any rate not by any major force. As soon as however there is an irregular manner of operation, it is possible, when the secondly locking part 58 is in engagement, for the first locking part 53 to shift—owing to the amount of play—some distance in the extension direction 28 so that the two locking surfaces 79 and 80 are thrust firmly together, as shown in FIG. 4. The play allowing for movement is at a minimum and it may be in the millimeter or tenth of a millimeter range.

In the illustrated example the second locking surface 80 of the projection 77 possesses a configuration corresponding to the external surface of a frustum of a cone, whose longitudinal axis coincides with the direction 60 of motion. The part with the maximum diameter faces the receiving opening 68, which is cut by the transverse hole 59. Owing to the radially symmetrical design however means to prevent relative rotation of the first locking part 53 are unnecessary, It is convenient, given a groove-like form of the first locking surface 79, for the recess flank 84, which is arranged oppositely and nearer to the drive piston 6, to be designed with a shape corresponding to the first locking surface 79. In the case of a longitudinal section taken on a plane placed axially in relation to the respective direction of movement it is accordingly possible for both the recess 76 and also the projection 77 to have a dovetail-like form.

Figure 5:
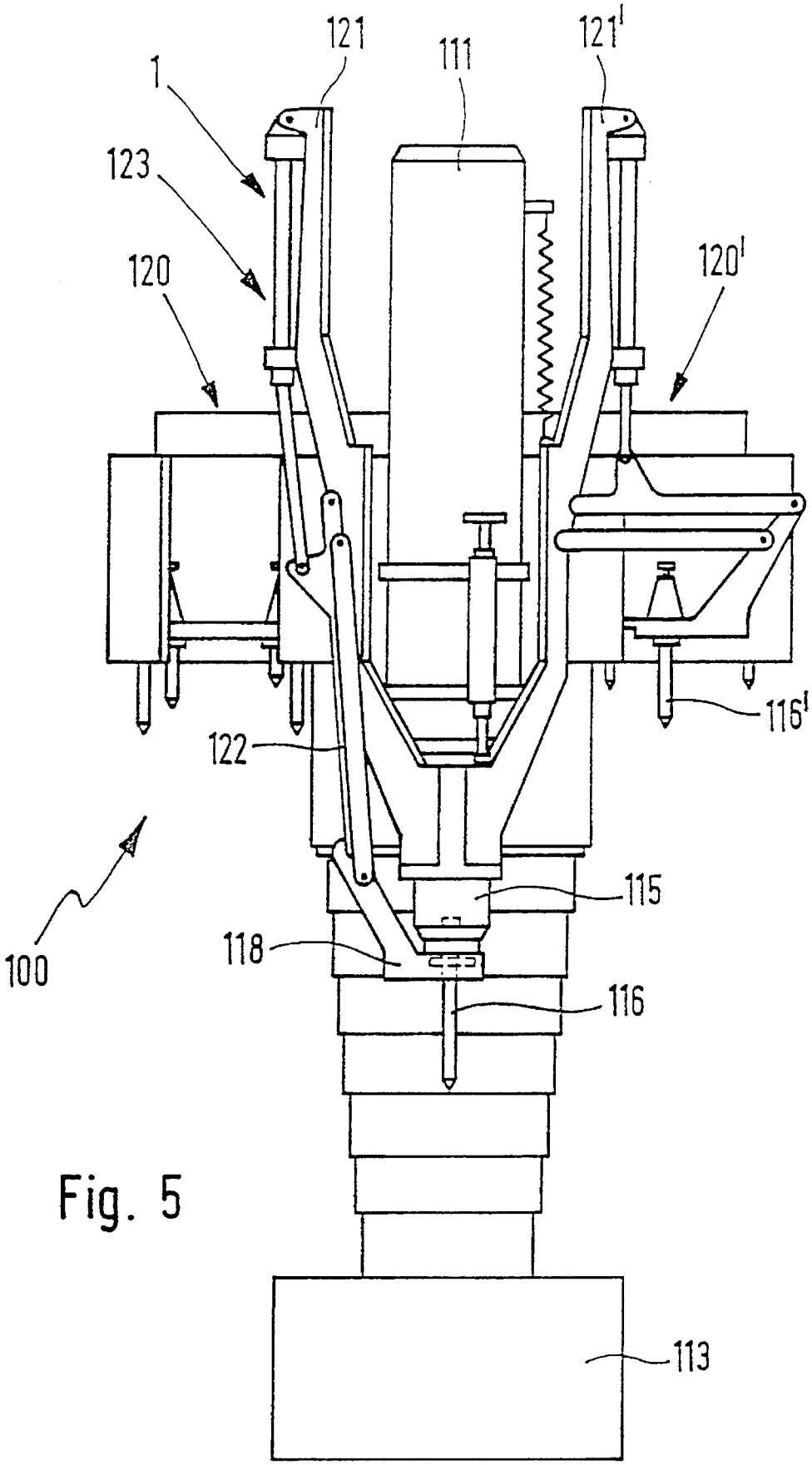
FIG. 5 shows a machine tool fitted with the drive cylinder in accordance with the invention.

The drive cylinder 1 may be employed for a large number of different applications, but however the main purpose (but not the only one) is use as a drive unit for the tool changer of a machine tool. In FIG. 5 a preferred design will be seen for this use. In particular in such figure 100 indicates a machine tool with a headstock 111, which is arranged on a base 113. In a shaft head 115 a production tool 116 is mounted, which is held by a holder 118 of a tool changer generally referenced 120. The tool changer 120 possesses a rigid part 121, which is articulated on a parallelogram linkage 122, which for its part carries the holder 118. Between the rigid part 121 and the parallelogram linkage 122 there is a drive unit 123 in the form of the drive cylinder 1 already described in conjunction with FIGS. 1 through 4 in detail.

When the drive unit 123 is located in the extended position, as is indicated on the left in FIG. 5, the production tool 116 will be in its operative setting. The machine tool 100 is provided with at least one further tool changer 120' which is depicted on the right in terms of FIG. 5 and bears a production tool 116', which is in the magazine position.

Owing to the integration of the locking unit 52, not depicted in FIG. 5, in the drive cylinder 1 there is on the one hand an extremely compact mechanical design which greatly simplifies assembly of the machine tool 100. Additional external component for fixing the position of the drive piston are in fact unnecessary, for when the release pressure drops the integrated locking unit 52 will ensure that the tool changer 120' remain in its upper position on the left in terms of FIG. 5. This offers the advantages for safety initially mentioned in detail.

We claim:

1. A machine tool comprising a headstock (111), at least one tool changer (120) adapted to move production tools (116) between a magazine position and a working position, and at least one fluid power drive cylinder (1) associated with the tool changer (120) as a drive unit (123), the drive cylinder having a cylinder housing (2), in which an axially moving piston (6) is arranged, the drive cylinder further including a locking means adapted to mechanically lock the axial movement of the piston in relation to the cylinder housing when a working pressure to the piston drops below a predetermined value and wherein a setting force due to the working pressure must be overcome to release said locking means.

2. The machine tool as claimed in claim 1, characterized in that the release pressure is an operating pressure of the drive cylinder (1).

3. The machine tool as claimed in claim 1, characterized in that said locking means (52) is integrated in the drive cylinder (1).

4. The machine tool as claimed in claim 1, characterized in that said locking means (52) comprises a first locking part (53), which is arranged on a side, which faces an end wall (4), of the drive piston (6) and is connected with the same for movement therewith, in that said locking means (52) possesses a second locking part (58) arranged in or on the end wall (4), said locking part (58) able to be moved transversely to a stroke direction (28 and 29) of the drive piston (6) between a locking position and a release position such that in the locking position, with the drive piston (6) in an end of stroke position, the second locking part (58) is in engagement with the first locking part (53), and in the release position, in order to permit axial stroke movement of the drive piston (6), the second locking part is out of engagement with the first locking part (53), in that the second locking part (58), in the condition of operational readiness of the drive cylinder (1), is subject to a fluid pressure urging it toward the release position, which is able to hold the locking part (58) against a biasing locking force action toward the locking position, during readiness to operate constantly in the release position.

5. The machine tool as claimed in claim 4, characterized in that the release pressure acting on the second locking part (58) is the operating pressure of the drive cylinder (1).

6. The machine tool as claimed in claim 4, characterized by a connection device (14) provided on the cylinder housing (2) and more especially on the end wall (4), for fluid pressure lines for the operating pressure, same communicating with a pressure fluid duct (67) provided in the interior of the cylinder housing (67) leading to the second locking part (58).

7. The machine tool as claimed in claim 4, characterized in that the second locking part (58) is biased by means of spring force (69) toward the locking position, such means preferably being a mechanical compression spring arrangement.

8. The machine tool as claimed in claim 4, characterized in that the second locking part (58) is connected with a locking piston (63) for entraining the same, which piston is able to be acted upon on the one side by the release pressure acting toward the release position.

9. The machine tool as claimed in claim 4, characterized in that the fluid pressure to maintain the release position is independent of the working pressure of the drive cylinder (1).

10. The machine tool as claimed in claim 4, characterized in that the locking means (74 and 75) of the two locking parts (53 and 58) are so designed that they are able to interlock each other in the setting direction (60) of the second locking part (58).

11. The machine tool as claimed in claim 4, characterized in that the locking means (74) of the first locking part (53) is constituted by a recess (76), into which the locking means (75), designed in the form of a projection (77), of the second locking part (58) may plunge in a direction athwart the stroke direction (28 and 29) of the drive piston (6).

12. The machine tool as claimed in claim 11, characterized in that the recess (76) is delimited on the axial side remote from the drive piston (6) by a first locking surface (79), which has at least one area portion further removed from a surface portion, which lies at a smaller depth and extends perpendicularly to the stroke direction (28 and 29) of the drive piston (6) and in that the projection (77) possesses an associated and preferably substantially complementary second locking surface (80), which assumes a position adjacent to the first locking surface (79), and when the first locking part (53) is in the arrested position such locking part (52) has some play to move in the stroke direction (28 and 29) of the drive piston (6).

13. The machine tool as claimed in claim 11, characterized in that the recess (76) is in the form of a sort of annular groove.

14. The machine tool as claimed in claim 4, characterized in that the first locking part (53) is provided on a bolt-like part (54), which can bear a buffer sleeve (48), which belongs to a damping device (47) for terminal damping of the drive piston (6) which is also provided in or on the end wall (4).

15. The machine tool as claimed in claim 1, characterized in that said locking means (52) is associated with an end wall (4) of the cylinder housing (2) and serves for a releasable mechanical locking of the drive piston (6) in an end of stroke position adjacent to the end wall (4).

16. The machine tool as claimed in claim 15, characterized in that the end wall (4) is constituted by an end plate of the drive cylinder (1), which is located on a piston side (56) facing away from a piston rod (32).

17. The machine tool as claimed in claim 15, characterized in that on the end wall (4) at least one power valve (16) is provided for fluid power control of the drive cylinder (1).

18. The machine tool as claimed in claim 15, characterized by an equipment space (18), which is closed by a removable protective hood (39) provided on the end (37) facing away from the drive piston (6), of the end wall (4), which space (38) includes pilot valves (34) which aid in controlling the drive cylinder (1).

19. The machine tool as claimed in claim 15, characterized in that a sensor device (43) is provided for detecting a position of the drive piston (6).

20. A machine tool comprising a headstock (111), at least one tool changer (120) adapted to move production tools (116) between a magazine position and a working position, and at least one fluid power drive cylinder (1) associated with the tool changer (120) as a drive unit (123), said drive cylinder having a cylinder housing (2), in which an axially moving piston (6) is arranged, said drive cylinder further including a locking device adapted to mechanically lock the axial movement of the piston in relation to the cylinder housing when a working pressure to the piston drops below a predetermined value, said locking means including a first locking part arranged on a side of the drive piston which faces an end wall in a retracted position and a second locking part arranged in or on the end wall for transverse movement with respect to a stroke direction of the drive cylinder between a locked position and a released position, wherein a setting force due to the working pressure must be overcome to release engagement of the first and second locking parts.

21. A machine tool comprising a headstock, at least one tool changer adapted to move production tools between a magazine position and a working position and at least one fluid power drive cylinder associated with the changer as a drive unit, said drive cylinder having a cylinder housing in which an axially moving piston is arranged, said drive cylinder further including a locking device, said locking device including a first locking part facing an end wall and a second locking part arranged in or on said end wall, said second locking part being transversely movable in relation to a stroke direction of said drive piston and movable between a locked position and a released position, said second locking part being subject to a fluid pressure urging said second locking part towards said release position, said fluid pressure holding said second locking part against a biasing locking force action towards said locked position, said first locking part being engagable with said second locking part when said drive piston is in an end of stroke position to prevent axial movement of said drive piston in relation to said cylinder housing, and wherein in the locked position it is not possible for the fluid pressure applied to said second locking part to place the locking device in said released position when said first locking part is subjected to a setting force, which acts to move said drive piston axially from said end of stroke position.

* * * * *

UNITED STATES PATENT AND TRADEMARK OFFICE

CERTIFICATE OF CORRECTION

PATENT NO. : 5,522,303
DATED : June 4, 1996
INVENTOR(S) : Stoll, et al.

It is certified that error appears in the above-indentified patent and that said Letters Patent is hereby corrected as shown below:

Title page, item [73], now reads "Festo KG of Ruiter, Essingen; Chiron - Werke GmbH & Co. KG, Tuttlingen, both of Germany", should read -- Festo KG, Esslingen; Chiron - Werke GmbH & Co. KG, Tuttlingen, both of Germany --.

Signed and Sealed this
Eleventh Day of February, 1997

Bruce Lehman

*Attest:*

BRUCE LEHMAN

*Attesting Officer*

*Commissioner of Patents and Trademarks*